US006116299A

United States Patent [19]

Cummins et al.

[11] Patent Number: 6,116,299

[45] Date of Patent: Sep. 12, 2000

[54] VENTED SELF SUPPORTING FILLING DEVICE

[76] Inventors: Lane A. Cummins, 11300 Titian Dr., Austin, Tex. 78758-4136; Donnie J. Strybos, 16836 Cranston Dr., Round Rock, Tex. 78660

[21] Appl. No.: 09/266,156

[22] Filed: Mar. 11, 1999

Related U.S. Application Data

[63] Continuation-in-part of application No. 08/873,938, Jun. 12, 1997, Pat. No. 5,899,246, which is a continuation-in-part of application No. 08/695,226, Aug. 6, 1996, abandoned.

[51] Int. Cl.[7] ..... B67C 11/00

[52] U.S. Cl. ..... 141/332; 141/340; 141/364; 141/375; D7/700; D15/150

[58] Field of Search ..... 141/331, 332, 141/340–342, 364, 375, 384; D7/700; D15/150; D23/200; 220/571, 571.1, 572

[56] References Cited

U.S. PATENT DOCUMENTS

| | | | |
|---|---|---|---|
| D. 407,643 | 4/1999 | Wirth | D7/700 |
| 578,671 | 3/1897 | Wisdom | 141/332 |
| 925,582 | 6/1909 | Kipp | 141/331 |
| 1,733,261 | 10/1929 | Higby et al. | 141/337 |
| 2,230,180 | 1/1941 | Collins | 141/342 |
| 2,250,910 | 7/1941 | Hiett | 141/339 |
| 2,833,319 | 5/1958 | Justus | 141/364 |
| 3,860,048 | 1/1975 | White | 141/375 |
| 4,832,095 | 5/1989 | Bonnell | 141/340 |
| 5,195,567 | 3/1993 | Tyree, Jr. | 141/331 |
| 5,385,180 | 1/1995 | Wittman | 141/340 |
| 5,472,025 | 12/1995 | Conrad et al. | 141/332 |
| 5,515,892 | 5/1996 | Najafi et al. | 141/331 |

*Primary Examiner*—J. Casimer Jacyna

[57] ABSTRACT

A vented self-supporting filling device for providing a filling device that can be stably positioned within an opening of a receiving container. The device includes a conical member having an open top end and an open bottom end, and a tubular member integrally joined to the conical member. The tubular member has an open upper end and an open lower end, wherein the open upper end is integrally joined to and communicates with the open bottom end of the conical member. A plurality of outer fingers outwardly project from the tubular member for stably supporting the filling device in a generally upright orientation when positioned within an opening of a receiving container. In addition, a plurality of inner fingers inwardly project from the conical member for stably supporting a pouring container when positioned within the filling device in an inverted orientation.

18 Claims, 6 Drawing Sheets

VENTED SELF SUPPORTING FILLING DEVICE

CROSS-REFERENCE TO RELATED APPLICATION

This application is a continuation-in-part of our prior utility application Ser. No. 08/873,938, filed Jun. 12, 1997, now U.S. Pat. No. 5,899,246, which was a continuation-in-part of our prior utility patent application Ser. No. 08/695,226, filed Aug. 06, 1996 now abandoned.

BACKGROUND OF THE INVENTION

1. Field of the Invention

The present invention relates to filling devices and more particularly pertains to a new vented self-supporting filling device for providing a filling device that can be stably positioned within an opening of a receiving container.

2. Description of the Prior Art

The use of filling devices is known in the prior art. More specifically, filling devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art filling devices include U.S. Pat. No. 4,711,276; U.S. Pat. No. 5,121,779; U.S. Pat. No. 5,277,234; U.S. Pat. No. 5,472,025; U.S. Pat. No. 5,385,180; and U.S. Pat. No. 4,494,585.

While these devices fulfill their respective, particular objectives and requirements, the aforementioned patents do not disclose a new vented self-supporting filling device. The inventive device includes a conical member having an open top end and an open bottom end, and a tubular member integrally joined to the conical member. The tubular member has an open upper end and an open lower end, wherein the open upper end is integrally joined to and communicates with the open bottom end of the conical member. A plurality of outer fingers outwardly project from the tubular member for stably supporting the filling device in a generally upright orientation when positioned within an opening of a receiving container. In addition, a plurality of inner fingers inwardly project from the conical member for stably supporting a pouring container when positioned within the filling device in an inverted orientation.

In these respects, the vented self-supporting filling device according to the present invention substantially departs from the conventional concepts and designs of the prior art, and in so doing provides an apparatus primarily developed for the purpose of providing a filling device that can be stably positioned within an opening of a receiving container.

SUMMARY OF THE INVENTION

In view of the foregoing disadvantages inherent in the known types of filling devices now present in the prior art, the present invention provides a new vented self-supporting filling device construction wherein the same can be utilized for providing a filling device that can be stably positioned within an opening of a receiving container.

The general purpose of the present invention, which will be described subsequently in greater detail, is to provide a new vented self-supporting filling device apparatus and method which has many of the advantages of the filling devices mentioned heretofore and many novel features that result in a new vented self-supporting filling device which is not anticipated, rendered obvious, suggested, or even implied by any of the prior art filling devices, either alone or in any combination thereof.

To attain this, the present invention generally comprises a conical member having an open top end and an open bottom end, and a tubular member integrally joined to the conical member. The tubular member has an open upper end and an open lower end, wherein the open upper end is integrally joined to and communicates with the open bottom end of the conical member. A plurality of outer fingers outwardly project from the tubular member for stably supporting the filling device in a generally upright orientation when positioned within an opening of a receiving container. In addition, a plurality of inner fingers inwardly project from the conical member for stably supporting a pouring container when positioned within the filling device in an inverted orientation.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature an essence of the technical disclosure of the application. The abstract is neither intended to define the invention of the application, which is measured by the claims, nor is it intended to be limiting as to the scope of the invention in any way.

It is therefore an object of the present invention to provide a new vented self-supporting filling device apparatus and method which has many of the advantages of the filling devices mentioned heretofore and many novel features that result in a new vented self-supporting filling device which is not anticipated, rendered obvious, suggested, or even implied by any of the prior art filling devices, either alone or in any combination thereof.

It is another object of the present invention to provide a new vented self-supporting filling device which may be easily and efficiently manufactured and marketed.

It is a further object of the present invention to provide a new vented self-supporting filling device which is of a durable and reliable construction.

An even further object of the present invention is to provide a new vented self-supporting filling device which is susceptible of a low cost of manufacture with regard to both materials and labor, and which accordingly is then susceptible of low prices of sale to the consuming public, thereby making such vented self-supporting filling device economically available to the buying public.

Still yet another object of the present invention is to provide a new vented self-supporting filling device which provides in the apparatuses and methods of the prior art some of the advantages thereof, while simultaneously overcoming some of the disadvantages normally associated therewith.

Still another object of the present invention is to provide a new vented self-supporting filling device for providing a filling device that can be stably positioned within an opening of a receiving container.

Yet another object of the present invention is to provide a new vented self-supporting filling device which includes a conical member having an open top end and an open bottom end, and a tubular member integrally joined to the conical member. The tubular member has an open upper end and an open lower end, wherein the open upper end is integrally joined to and communicates with the open bottom end of the conical member. A plurality of outer fingers outwardly project from the tubular member for stably supporting the filling device in a generally upright orientation when positioned within an opening of a receiving container. In addition, a plurality of inner fingers inwardly project from the conical member for stably supporting a pouring container when positioned within the filling device in an inverted orientation.

Still yet another object of the present invention is to provide a new vented self-supporting filling device that may be firmly positioned within an opening of a receiving container so as to maintain a generally upright orientation during use.

Even still another object of the present invention is to provide a new vented self-supporting filling device that allows for venting of air from a receiving container during transfer of material thereto. Thus, allowing for quicker transfer of material from a pouring container to the receiving container.

Even still another object of the present invention is to provide a new vented self-supporting filling device that can accommodate receiving containers having various sized openings.

Even still another object of the present invention is to provide a new vented self-supporting filling device that allows a pouring container to be stably positioned therein in an inverted orientation.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
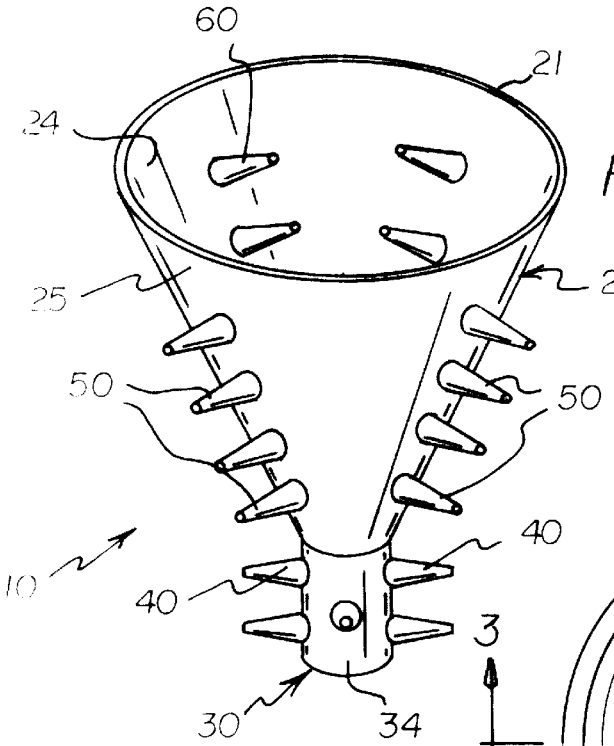
FIG. 1 is a perspective view of a new vented self-supporting filling device according to the present invention.
Figure 2:
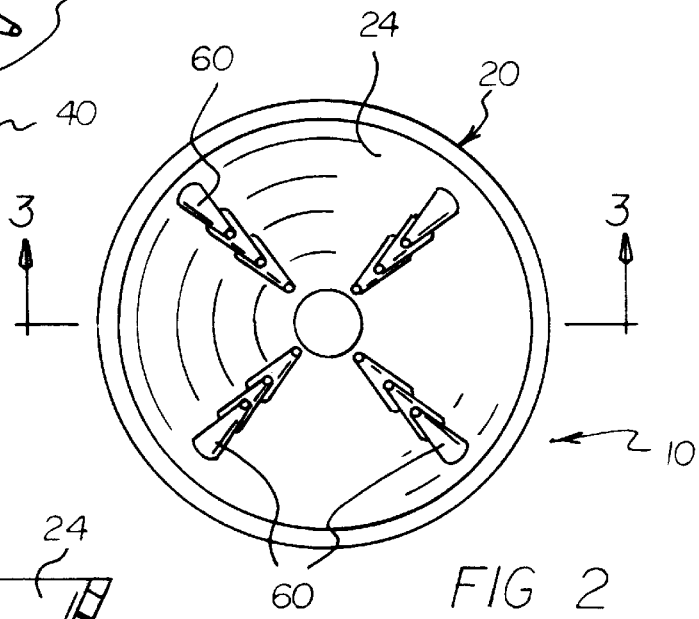
FIG. 2 is a top view thereof.
Figure 3:
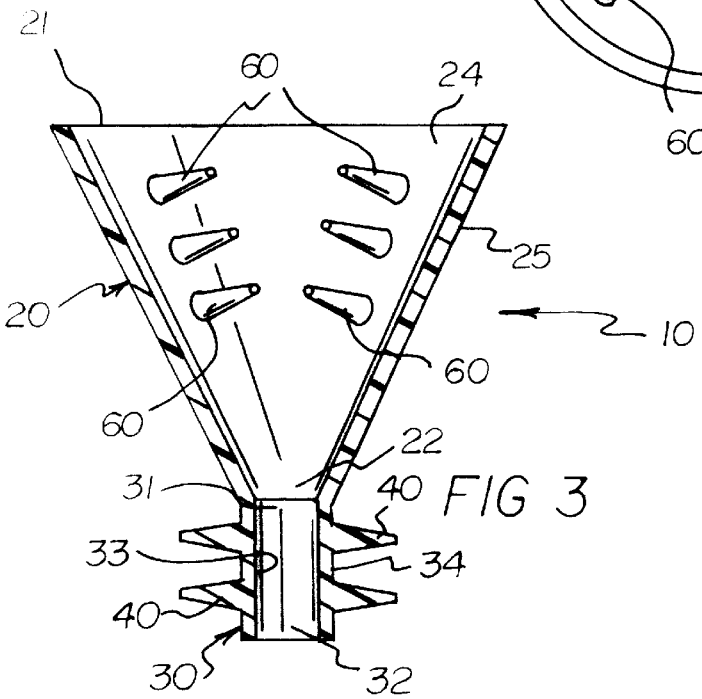
FIG. 3 is a cross sectional view taken along line 3—3 of FIG. 2.
Figure 4:
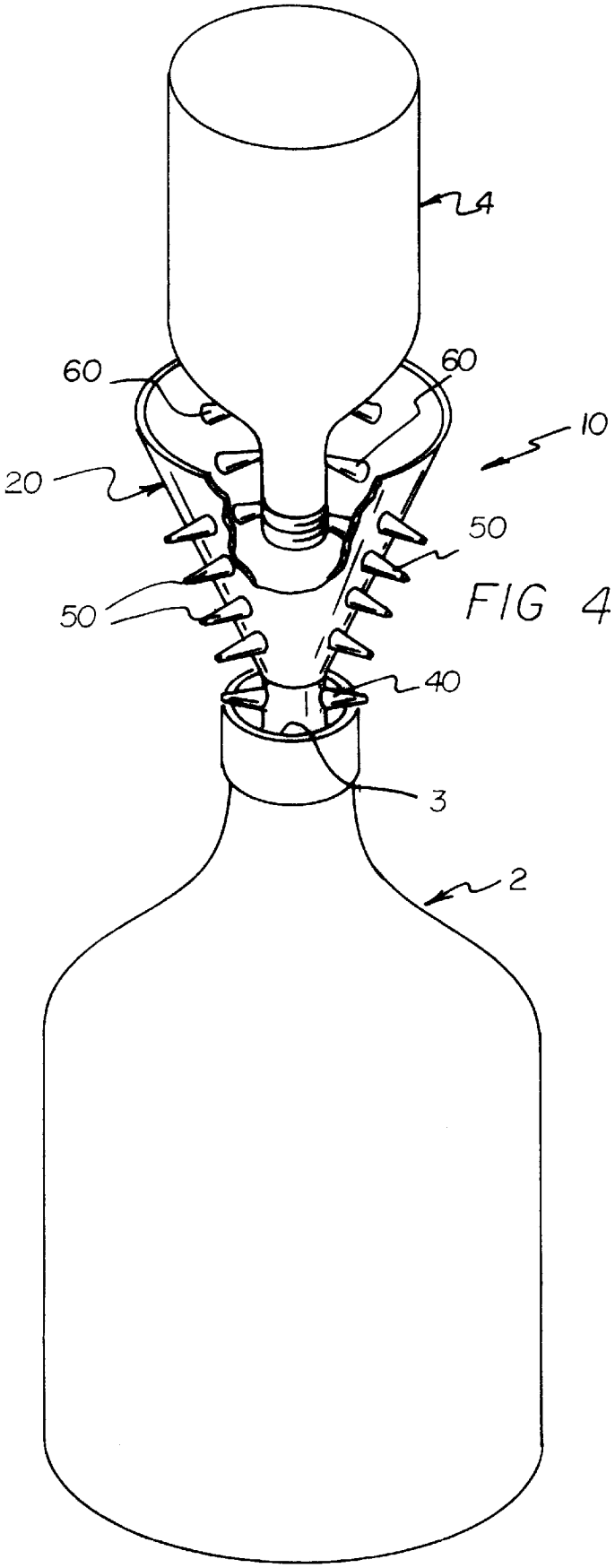
FIG. 4 is an illustration of the present invention in use.

With reference now to the drawings, and in particular to FIGS. 1 through 11 thereof, a new vented self-supporting filling device embodying the principles and concepts of the present invention and generally designated by the reference numeral 10 will be described.

As best illustrated in FIGS. 1 through 11, the vented self-supporting filling device 10 comprises a conical member 20 having an open top end 21 and an open bottom end 22, and a tubular member 30 integrally joined to the conical member 20. The tubular member 30 has an open upper end 31 and an open lower end 32, wherein the open upper end 31 is integrally joined to and communicates with the open bottom end 22 of the conical member 20. A plurality of outer fingers 40 outwardly project from the tubular member 30 for stably supporting the filling device 10 in a generally upright orientation when positioned within an opening 3 of a receiving container 2. In addition, a plurality of inner fingers 60 inwardly project from the conical member 20 for stably supporting a pouring container 4 when positioned within the filling device 10 in an inverted orientation.

The conical member 20 has a tapered body tapering from the open top end 21 to the open bottom end 22. The conical member 20 includes an annular rim 23 along the open top end 21 thereof. In addition, the conical member 20 has an inner surface 24 and an outer surface 25. The tubular member 30 also has an inner surface 33 and an outer surface 34.

As best illustrated in FIGS. 1 through 4, a plurality of first outer fingers 40 project outward from the outer surface 34 of the tubular member 30 wherein the first outer fingers 40 are radially spaced around the tubular member 30. Preferably, the first outer fingers 40 extend along the outer surface 34 of the tubular member 30 from substantially the open upper end 31 to the open lower end 32. Accordingly, a number of the first outer fingers 40 fit within the opening 3 of the receiving container 2 and a number of the first outer fingers 40 protrude above the opening 3. As such, the first outer fingers 40 stably retain the filling device 10 within the opening 3 in a generally upright orientation.

As best illustrated in FIGS. 1 through 4, a plurality of second outer fingers 50 project outward from the outer surface 25 of the conical member 20 wherein the second outer fingers 50 are radially spaced around the conical member 20. Preferably, a plurality of outer columns of second outer fingers 50 are spaced around the conical member 20. In addition, each of the outer columns of second outer fingers 50 extend along the outer surface 25 of the conical member 20 from substantially the open top end 21 to the open bottom end 22.

The first outer fingers 40 and the second outer fingers 50 prevent the outer surface 25 of the conical member 20 from engaging the opening 3 of the receiving container 2, thereby preventing the conical member 20 from forming an airtight seal with the receiving container 2. Thus, the first outer fingers 40 and the second outer fingers 50 create an air space between the filling device 10 and the receiving container 2, thereby allowing for quicker transfer of material from a pouring container 4 to the receiving container 2.

As best illustrated in FIGS. 1 through 4, a plurality of inner fingers 60 project inward from the inner surface 24 of the conical member 20 wherein the inner fingers 60 are radially spaced within the conical member 20. Preferably, a plurality of inner columns of inner fingers 60 are spaced within the conical member 20. In addition, each of the inner columns of inner fingers 60 extend along the inner surface 24 of the conical member 20 from substantially the open top end 21 to the open bottom end 22. As such, the inner fingers 60 effectively grip and stably support the pouring container 4 when positioned within the filling device 10 in a generally inverted orientation. In addition, when used with a pouring container having a neck, the inner fingers 60 grip the neck and stably retain the pouring container therewithin.

In a preferred embodiment, each of the first outer fingers 40, second outer fingers 50, and inner fingers 60 are generally flexible. Accordingly, each are preferably formed of a flexible rubber material. As such, a number of the first outer fingers 40 and the second outer fingers 50 bend to fit within the opening 3 of the receiving container 2. In addition, a number of the inner fingers 60 bend to conform to the profile of the pouring container 4.

In a preferred embodiment, each of the first outer fingers 40, second outer fingers 50, and inner fingers 60 are integrally formed with the conical member 20 and the tubular member 30, respectively. In an optional embodiment, however, each of the first outer fingers 40, second outer fingers 50, and inner fingers 60 are separable from the conical member 20 and the tubular member 30, respectively.

Figure 5:
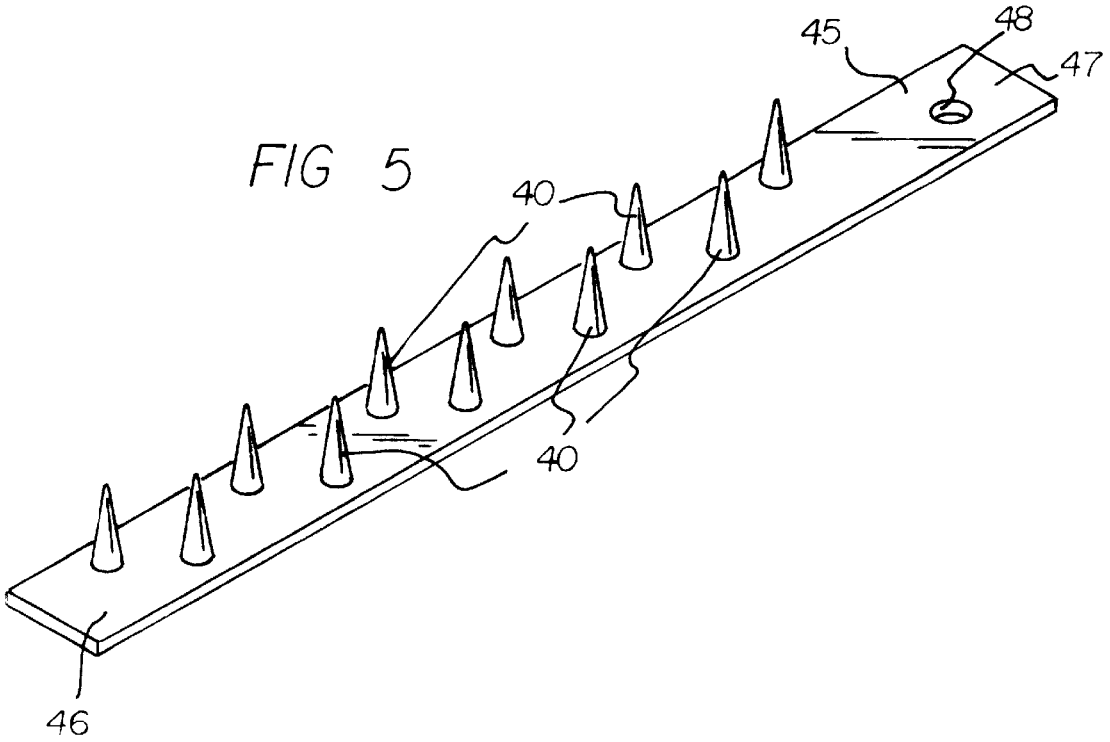
FIG. 5 is an illustration of the flexible strip and the plurality of fingers extending therefrom according to the present invention.
Figure 6:
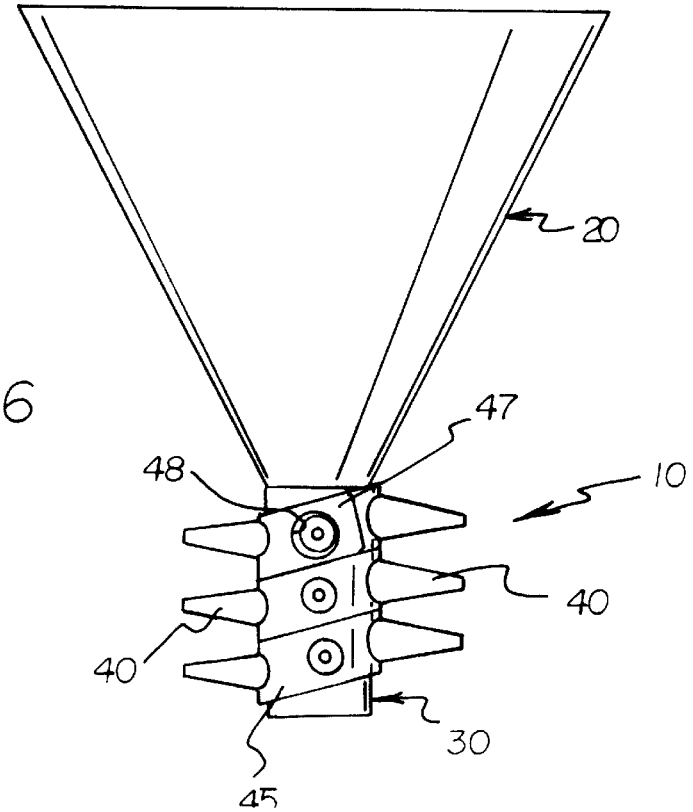
FIG. 6 is an illustration of the flexible strip wound around the filling device according to the present invention.

In an optional embodiment, best illustrated in FIGS. 5 and 6, the first outer fingers 40 are disposed on a flexible strip 45 having a first end 46 and a second end 47. Accordingly, each of the first outer fingers 40 are spaced along the flexible strip 45. In addition, the flexible strip 45 has a hole 48 therein adjacent the second end 47. As such, the flexible strip 45 is spirally wound around the outer surface 34 of the tubular member 30. One of the first outer fingers 40 is inserted through the hole 48 provided in the flexible strip 45 such that the flexible strip 45 is retained on the tubular member 30.

Figure 7:
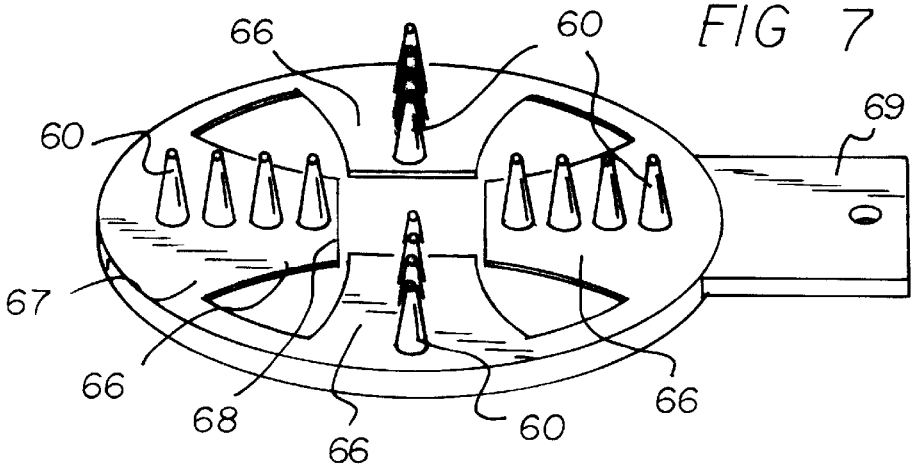
FIG. 7 is an illustration of the annular member and the plurality of fingers extending therefrom according to the present invention.
Figure 8:
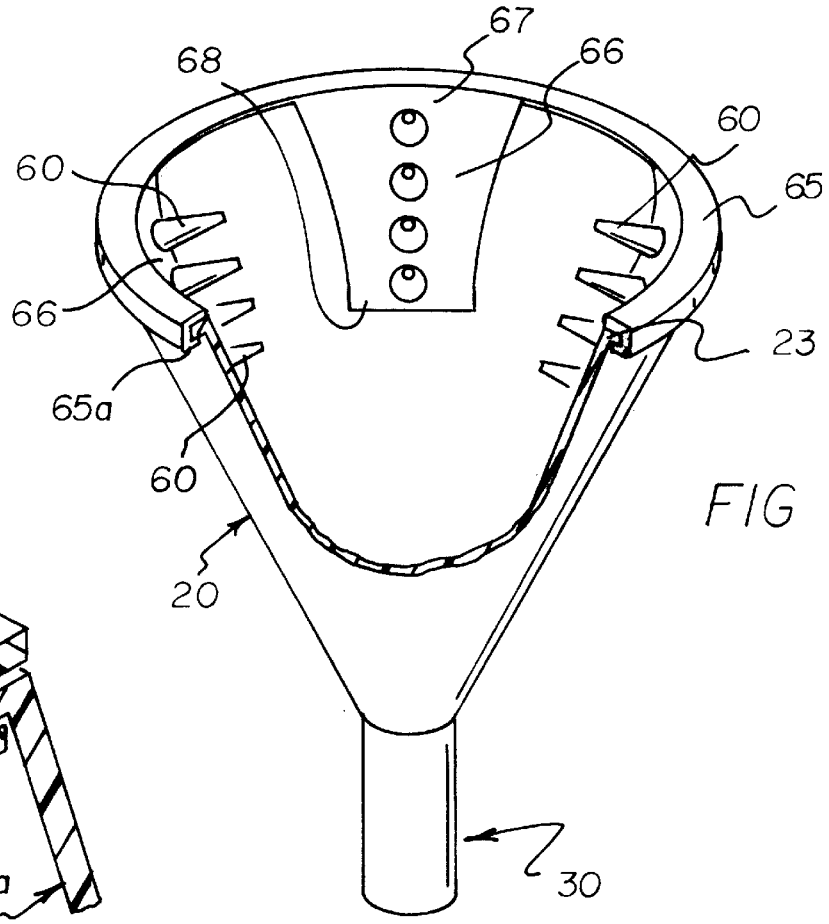
FIG. 8 is an illustration of the annular member secured to the filling device according to the present invention.
Figure 8A:
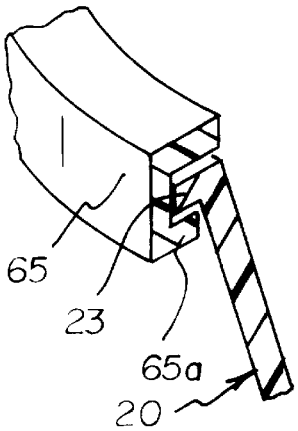
FIG. 8*a* is a detailed illustration of area 8*a* of FIG. 8.

In an optional embodiment, best illustrated in FIGS. 7 and 8, the inner fingers 60 are disposed on a plurality of flexible members 66 each attached to an annular member 65 that is securable to the conical member 20. Each of the flexible members 66 extend inward from the annular member 65 towards the center thereof. Each of the flexible members 66 have a first end 67 integrally joined to the annular member 65 and a second end 68 which is free. As such, the plurality of flexible members 66 are allowed to extend into the conical member 20 along the inner surface 24 thereof. Preferably, the plurality of flexible members 66 comprise a first pair of flexible members diametrically opposed to each other and a second pair of flexible members diametrically opposed to each other and perpendicularly oriented to the first pair of flexible members.

The annular member 65 includes an annular lip 65*a*. Accordingly, the annular lip 65*a* is adapted to receive the annular rim 23 of the conical member 20 such that when the annular member 65 is press fit onto the annular rim 23, the annular rim 23 releasably engages the annular lip 65*a*. A pull tab 69 extends beyond the periphery of the annular member 65 to facilitate removal of the annular member 65 from the annular rim 23 of the conical member 20.

Figure 9:
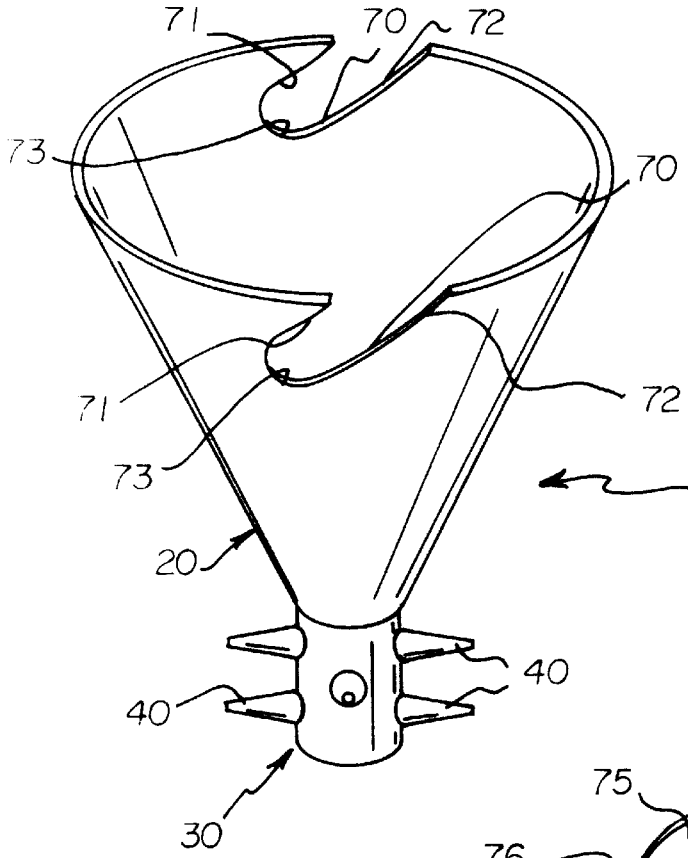
FIG. 9 is an illustration of a first embodiment of the filling device adapted for retaining a pouring container according to the present invention.
Figure 10:
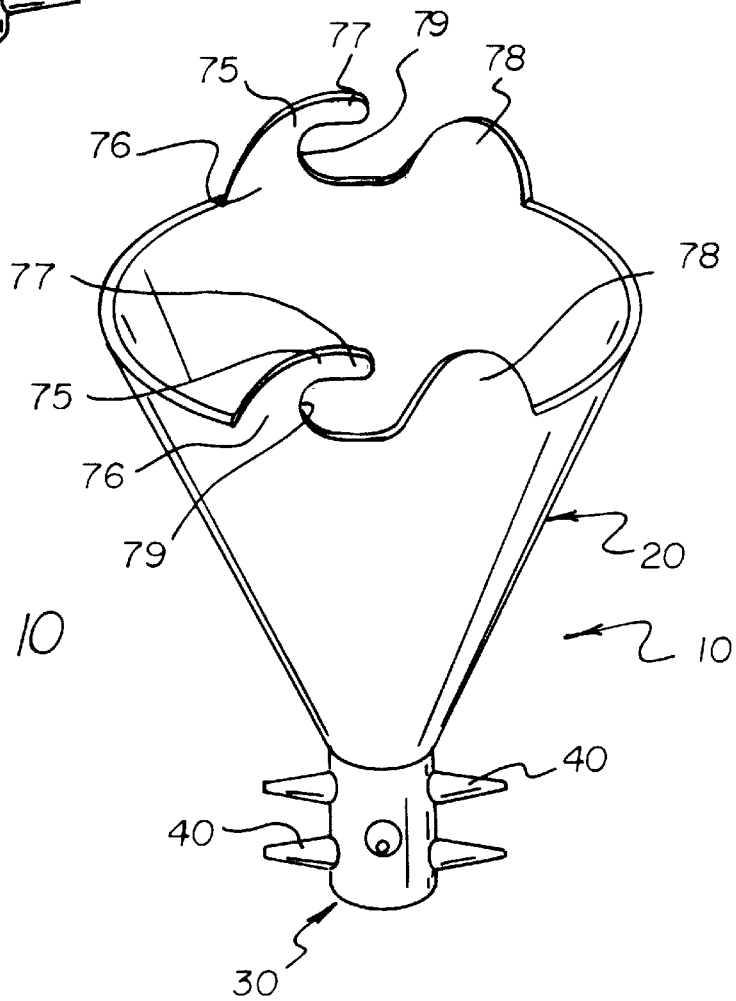
FIG. 10 is an illustration of a second embodiment of the filling device adapted for retaining a pouring container according to the present invention.

As best illustrated in FIGS. 9 and 10, the filling device 10 is adapted for receiving and retaining the pouring container 4 in a generally angled orientation. Accordingly, in a first embodiment, the conical member 20 has a pair of aligned slots 70 therein. Each of the slots 70 are arcuate-shaped and extend into contiguous communication with the annular rim 23 of the conical member 20. Accordingly, each of the slots 70 include an upper arcuate edge portion 71, a lower arcuate edge portion 72, and an end edge portion 73 interconnecting the upper arcuate edge portion 71 and the lower arcuate edge portion 72. As such, the pouring container 4 may engage the conical member 20 such that the upper arcuate edge portion 71 of each of the slots 70 extends into an opening of the pouring container 4. Accordingly, the pouring container 4 generally abuts the end edge portion 73 and the lower arcuate edge portion 72 of each of the slots 70.

In a second embodiment, a pair of aligned arms 75 protrude from the annular rim 23 of the conical member 20. In addition, a pair of support ridges 78 protrude from the annular rim 23 adjacent the pair of aligned arms 75. Each of the arms 75 have a first end 76 integral with the conical member 20 and a second end 77 extending above and along the annular rim 23 of the conical member 20 in spaced relation to the annular rim 23. Thus, each of the arms 75 form a notch 79 adapted for receiving the pouring container 4. The support ridges 78 are positioned along the annular rim 23 of the conical member 20 in spaced relation to the second end 77 of each of the arms 75. As such, the pouring container 4 may engage the conical member 20 such that each of the arms 75 extend into the opening of the pouring container 4. Accordingly, the pouring container 4 generally abuts each of the support ridges 78.

Figure 11:
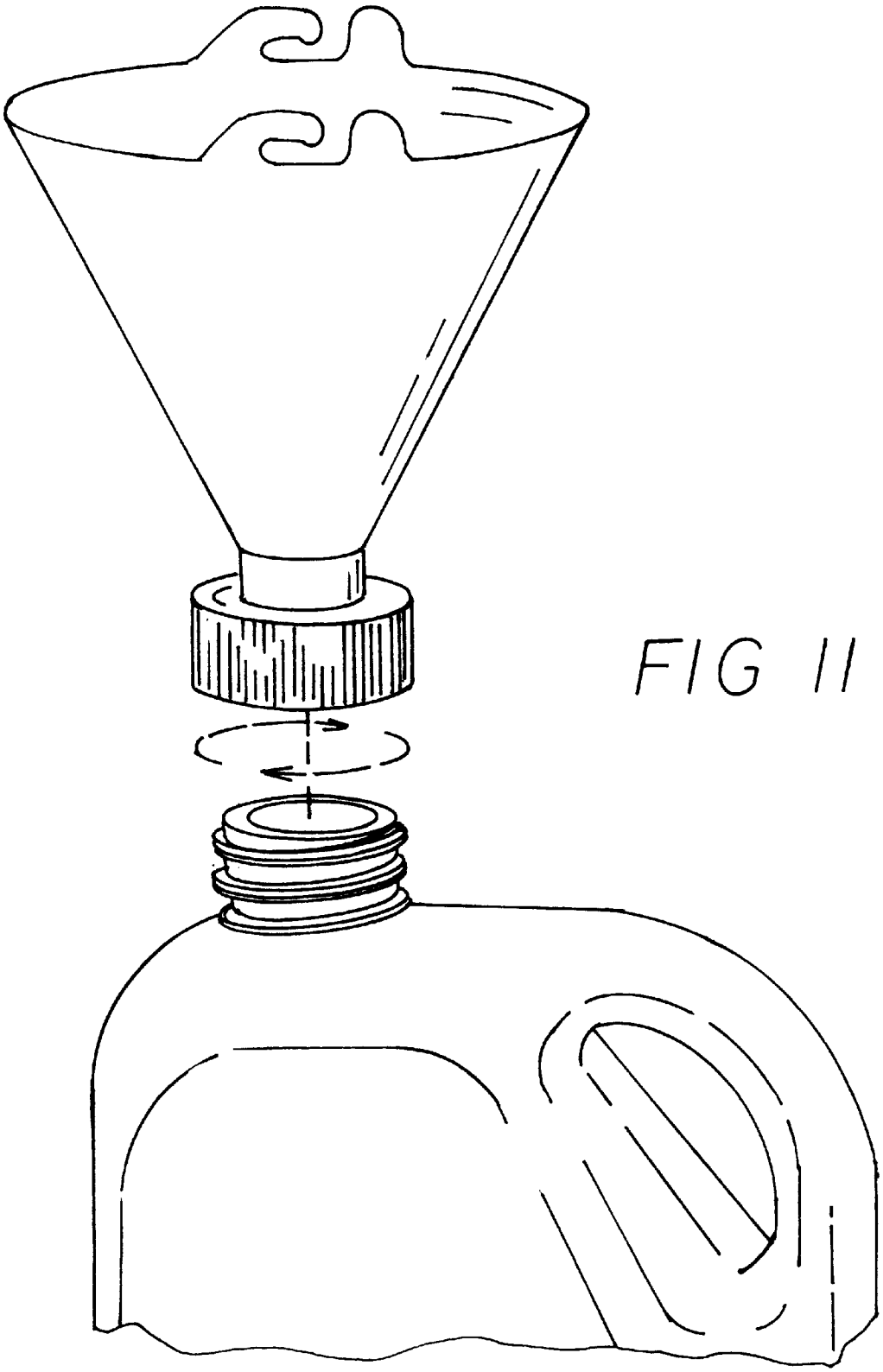
FIG. 11 is an illustration of a third embodiment of the filling device adapted for retaining a pouring container according to the present invention.

In a third embodiment, shown in FIG. 11, includes a cap 52 for coupling the conical member 20 and the tubular member 30 of the filling device 10 to the mouth opening 3 of a receiving container 2. The cap 52 has a cylindrical wall 54, and preferably the interior surface of the cylindrical wall has threads (not shown) formed thereon for mating to the threads 5 of the opening 3 of the container 2. An annular shoulder 56 is mounted on the cylindrical wall 54, and the annular shoulder 56 defines an aperture 58. The open lower end 32 of the tubular member 30 is coupled to the annular shoulder 56 of the cap 52 in a manner such that the open lower end 32 is in communication with the aperture 58. This structure permits easy and secure filling of the container without spillage from liquid escaping out of the mouth of the container or tipping of the filling device off of the container. Optionally, the cap may be integrally formed with a mouth of the receiving container 2 for easier filling.

In use, the user inserts the tubular member 30 within the opening 3 of the receiving container 2. As such, the first outer fingers 40 stably retain the filling device 10 within the opening 3 in a generally upright orientation. Thus, the user may pour material through the filling device 10 without having to manually restrain the filling device 10 within the opening 3 of the container 2. In addition, the first outer fingers 40 and the second outer fingers 50 create an air space between the filling device 10 and the receiving container 2, thereby facilitating transfer of material from the pouring container 4 to the receiving container 2.

With the filling device 10 in position, the user may then position the pouring container 4 within the conical member 20 in a generally inverted orientation. As such, the inner fingers 6 effectively grip and stably support the pouring container 4. Thus, the user may allow the contents of the pouring container 4 to drain through the filling device 10 without having to manually restrain the pouring container 4 and without the risk of tipping and spilling.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A filling device for use in transferring material from a pouring container to a receiving container having an opening, said filling device comprising:

a conical member having an open top end, an open bottom end, an inner surface, and an outer surface, said conical member tapering from said open top end to said open bottom end;

a tubular member for insertion into said opening of said receiving container, said tubular member being integrally joined to said conical member, said tubular member having an open upper end and an open lower end, said open upper end of said tubular member integrally joined to and communicating with said open bottom end of said conical member; and a retention means for retaining said pouring container adjacent to said open top end of said conical member;

wherein said conical member has an annular rim along said open top end thereof, and wherein said retention means comprises a pair of slots formed in said annular rim of said conical member at substantially diametrically opposite locations on said annular rim;

wherein each of said slots is elongate with a longitudinal axis, and wherein said longitudinal axis of each of said slots is oriented at an angle to said annular rim.

2. The filling device of claim 1 wherein said angle measures between about 30 degrees and about 60 degrees.

3. The filling device of claim 1 wherein said retention means is adapted to hold said container in a generally angled orientation with respect to said open top end of said conical member.

4. The filling device of claim 1 wherein said retention means is located between said open top end and said open bottom end of said conical member.

5. The filling device of claim 1 wherein said conical member has an annular rim along said open top end thereof, and wherein said retention means comprises a pair of arms protruding from said annular rim of said conical member at substantially diametrically opposite locations on said annular rim, each of said pair of arms having a first end integral with said conical member and a second end extending above and along said annular rim of said conical member in spaced relation thereto, and a pair of support ridges each protruding from said annular rim of said conical member adjacent said pair of arms.

6. The filling device of claim 1 additionally comprising a cap for coupling said conical member and said tubular member to a mouth of a container, said cap having a cylindrical wall with threads formed on an interior surface of said cylindrical wall, and an annular shoulder mounted on said cylindrical wall and defining an aperture, said open lower end of said tubular member being coupled to said annular shoulder of said cap such that the open lower end is in communication with said aperture.

7. A filling device for use in transferring material from a pouring container to a receiving container having an opening, said filling device comprising:

a conical member having an open top end, an open bottom end, an inner surface, and an outer surface, said conical member tapering from said open top end to said open bottom end;

a tubular member for insertion into said opening of said receiving container, said tubular member being integrally joined to said conical member, said tubular member having an open upper end and an open lower end, said open upper end of said tubular member integrally joined to and communicating with said open bottom end of said conical member; and a retention means for retaining said pouring container adjacent to said open top end of said conical member;

wherein said conical member has an annular rim along said open top end thereof, and wherein said retention means comprises a pair of arms protruding from said annular rim of said conical member at substantially diametrically opposite locations on said annular rim, each of said pair of arms having a first end integral with said conical member and a second end extending above and along said annular rim of said conical member in spaced relation thereto, and a pair of support ridges each protruding from said annular rim of said conical member adjacent said pair of arms;

wherein each of said arms extends substantially parallel to said annular rim such that a slot is formed between said arms and said annular rim.

8. The filling device of claim 7 wherein said conical member has an annular rim along said open top end thereof, and wherein said retention means comprises a pair of slots formed in said annular rim of said conical member at substantially diametrically opposite locations on said annular rim.

9. The filling device of claim 8 wherein each of said slots is elongate with a longitudinal axis, and wherein said longitudinal axis of each of said slots is oriented at an angle to said annular rim.

10. The filling device of claim 7 wherein each of said slots is elongate with a longitudinal axis, and wherein said longitudinal axis of each of said slots is oriented substantially parallel to said annular rim.

11. The filling device of claim 10 wherein each of said support ridges comprises a semicircular protrusion from said annular rim.

12. A filling device for use in transferring material from a pouring container to a receiving container having an opening, said filling device comprising:

a conical member having an open top end, an open bottom end, an inner surface, and an outer surface, said conical member tapering from said open top end to said open bottom end;

a tubular member for insertion into said opening of said receiving container, said tubular member being integrally joined to said conical member, said tubular member having an open upper end and an open lower end, said open upper end of said tubular member integrally joined to and communicating with said open bottom end of said conical member; and a pair of slots formed on said conical member adjacent said open top for supporting a pouring container on said open top end of said conical member;

wherein each of said slots is elongate with a longitudinal axis, and wherein said longitudinal axis of each of said slots is oriented at an angle to said annular rim wherein said angle measures between about 30 degrees and about 60 degrees, and wherein each of said slots is located between said open top end and said open bottom end of said conical member.

13. The filling device of claim 12 wherein said conical member has an annular rim along said open top end thereof, and wherein said retention means comprises a pair of arms protruding from said annular rim of said conical member at substantially diametrically opposite locations on said annular rim, each of said pair of arms having a first end integral with said conical member and a second end extending above and along said annular rim of said conical member in spaced relation thereto, and a pair of support ridges each protruding from said annular rim of said conical member adjacent said pair of arms, wherein each of said arms extends substantially parallel to said annular rim such that a slot is formed between said arms and said annular rim, wherein each of said slots is elongate with a longitudinal axis, and wherein said longitudinal axis of each of said slots is oriented substantially parallel to said annular rim, and wherein each of said support ridges comprises a semicircular protrusion from said annular rim.

14. The filling device of claim 12 additionally comprising an external support means for stably supporting said filling device in said opening of said receiving container.

15. A filling device for use in transferring material from a pouring container to a receiving container having an opening, said filling device comprising:

a conical member having an open top end, an open bottom end, an inner surface, and an outer surface, said conical member tapering from said open top end to said open bottom end;

a tubular member integrally joined to said conical member, said tubular member having an open upper end and an open lower end, said open upper end of said tubular member integrally joined to and communicating with said open bottom end of said conical member, said tubular member having an outer surface, said tubular member insertable into said opening of said receiving container; and an external support means for stably supporting said filling device within said opening of said receiving container, said external support means comprising a flexible strip having a first end and a second end, and a plurality of fingers being disposed on said flexible strip, each of said plurality of fingers being spaced along said flexible strip, said flexible strip being mounted on said outer surface of said tubular member for stably supporting said filling device within said opening of said receiving container.

16. The filling device of claim 15 wherein said flexible strip has a hole therein adjacent said second end thereof, one of said plurality of fingers being insertable through said hole for retaining said flexible strip on said tubular member.

17. The filling device of claim 15 wherein said conical member has an annular rim along said open top end thereof, and further comprising:

an annular member including an annular lip, said annular lip receiving said annular rim of said conical member when said annular member is press fit onto said annular rim, and a plurality of flexible members each integrally joined at one end to and inwardly extending from said annular member, said plurality of inner fingers being disposed on said plurality of flexible members wherein a number of said plurality of inner fingers are spaced along one of said plurality of flexible members.

18. The filling device of claim 17 wherein said plurality of flexible members comprises:

a first pair of flexible members diametrically opposed to each other, and a second pair of flexible members diametrically opposed to each other and perpendicularly oriented to said first pair of flexible members.

* * * * *